US006128797A

United States Patent [19]

Shaffer

[11] Patent Number: 6,128,797

[45] Date of Patent: Oct. 10, 2000

[54] FACE DOWN TANNING AND MASSAGE PAD

[76] Inventor: Timothy A. Shaffer, 1062 W. Stephens Dr., Tempe, Ariz. 85293

[21] Appl. No.: 09/216,960

[22] Filed: Dec. 21, 1998

Related U.S. Application Data

[60] Provisional application No. 60/071,258, Dec. 22, 1997.

[51] Int. Cl.[7] ..... A47C 20/00

[52] U.S. Cl. ..... 5/638; 5/724; 5/725; 5/652.1

[58] Field of Search ..... 5/638, 636, 725, 5/644, 622, 621, 724, 652.1

[56] References Cited

U.S. PATENT DOCUMENTS

| | | | |
|---|---|---|---|
| D. 298,992 | 12/1988 | Voss | 5/638 X |
| D. 337,914 | 8/1993 | McDonald | 5/638 X |
| 1,542,674 | 6/1925 | Darling | 5/638 X |
| 2,807,033 | 9/1957 | Austen | 5/725 |
| 2,959,794 | 9/1960 | Souleles . | |
| 3,140,497 | 7/1964 | Carswell | 5/638 |
| 3,266,061 | 8/1966 | Fuechsel . | |
| 3,315,282 | 4/1967 | Lowery et al. | 5/638 |
| 3,747,916 | 7/1973 | Benson | 269/322 |
| 3,897,102 | 7/1975 | Lemaire | 297/191 |
| 4,207,635 | 6/1980 | Leroy | 5/437 |
| 4,723,329 | 2/1988 | Vaccaro | 5/455 |
| 4,941,222 | 7/1990 | Prager | 5/111 |
| 5,222,779 | 6/1993 | Johnson | 297/191 |
| 5,237,713 | 8/1993 | Prager | 5/465 |
| 5,632,050 | 5/1997 | Zajas et al. | 5/725 X |

FOREIGN PATENT DOCUMENTS

| | | |
|---|---|---|
| 69079 | 1/1983 | European Pat. Off. . |
| 2431271 | 3/1980 | France . |
| 1391506 | 4/1975 | United Kingdom . |

*Primary Examiner*—Terry Lee Melius
*Assistant Examiner*—Fredrick Conley
*Attorney, Agent, or Firm*—Richard C. Litman

[57] ABSTRACT

A support cushion for face down tanning or massage. The cushion is composed of inflatable plastic or rubber material, or solid foam material, and has an elongated recess for accommodating a person's face. Ventilation apertures extend from each side of the cushion and communicates with the recess to provide a constant fresh air supply.

5 Claims, 4 Drawing Sheets

FACE DOWN TANNING AND MASSAGE PAD

CROSS-REFERENCE TO RELATED APPLICATION

This application claims the benefit of U.S. Provisional Patent Application Serial No. 60/071,258, filed Dec. 22, 1997.

BACKGROUND OF THE INVENTION

1. FIELD OF THE INVENTION

The present invention generally relates to support cushions, and more particularly, to a body support cushion or pad for face down tanning, or a massage.

2. DESCRIPTION OF RELATED ART

Various support cushions have been developed in the past to meet a variety of needs. The related art discloses full body supports with or without openings for accommodating the face of a user. However, these supports do not provide a proper support for the spinal column and the upper body portion when a person is lying in a prone position, thereby possibly imparting postural strain and discomfort. Furthermore, these supports are not readily portable, because they are generally rather bulky and heavy, and require considerable space for storage and transport.

It is normal for a person to recline in a prone position or face-down position when sunbathing or when having one's back and/or neck massaged. It is difficult for one to lie in a prone position, however, because of the need to maintain normal breathing. Consequently, the head must be turned to one side for normal breathing, or the head must be elevated somehow to expose the mouth and nose for normal breathing. The effect of the former may be to cause a twist in the neck, and in the latter, added pressure to the nose and mouth, thereby causing not inconsiderable discomfort.

Representative, related art disclosures will now be discussed in detail.

U.S. Pat. No. 2,959,794 issued to Souleles on Nov. 15, 1960, discloses a mattress for face down sleeping. The mattress has a forward portion with an opening for accommodating a person's face, and an aperture for air intake. This mattress does not provide a spinal column support, because the mattress has an even surface which may cause a postural strain when a person is lying in a prone position.

U.S. Pat. No. 3,266,061 issued to Fuechsel on Aug. 16, 1966, describes a couch configured to fit a person's body, and having an opening with straps to accommodate a person's face. This couch is not easily moved from one place to another. In addition, the device requires leg members and wheels to support it in a standing position, so that a person having one's face in the opening may breathe without being suffocated. The device does not appear to work if it is positioned horizontally.

U.S. Pat. No. 3,747,916 issued to Benson on Jul. 24, 1973, teaches a chiropractic table, including a bench-type support, armrests, a recess to accommodate a person's face, leg supports, an elevated block and a pad. This table does not provide comfortable structure for a person to lie in a prone position because of the awkward position to which one has to adjust. In addition, the table is not readily portable and thus could be very difficult to move around.

U.S. Pat. No. 3,897,102 issued to Lemaire on Jul. 29, 1975, discloses a lounge chair having a frame and flexible material associated with the frame, with a hole configured for a person's face, and two openings for insertion of the hands therethrough. This chair does not provide much convenience and comfort when a person is lying in a prone position, because the configuration as well as the flexible material of the device may cause a postural strain.

U.S. Pat. No. 4,207,635 issued to Leroy on Jun. 17, 1980, shows a lounger having an abdominal support and an opening for accommodating a person's face, and other accessories. This lounger does not provide a ventilating hole when it is flat on the ground. Additionally, the lounger is bulky to the extent that it is not readily portable or easily stored.

U.S. Pat. No. 4,723,329 issued to Vaccaro on Feb. 9, 1988, discloses an air mattress having inflated tubes and a recess to fit a person's face in a prone position. This mattress does not provide a ventilating passage for breathing, nor sufficient head support so as to avoid a twist in the neck when a person lies in a prone position.

U.S. Pat. Nos 4,941,222 and 5,237,713 issued to Prager on Jul. 17, 1990, and Aug. 24, 1993, respectively, describe a portable, adjustable lounge with an opening to fit a person's face. This lounge material (canvas, plastic bands and woven fiber glass) may cause discomfort when one lies against the material. In addition, the lounge is not adjustable to an appropriate height for the upper body portion so as to reduce postural strain.

U.S. Pat. No. 5,222,779 issued to Johnson on Jun. 29, 1993, illustrates a chaise lounge having an aperture to accommodate a person's face. This lounge can be uncomfortable in use, both because of the configuration of the device as well as the material used.

European Patent No. 69,079 issued to Borzia on Jan. 5, 1983, teaches a cushion made from polyurethane with internal springs. The device does not provide an upper body support to reduce spinal column and neck strain.

Great Britain Patent No. 1,391,506 issued to Grabham on Apr. 23, 1975, shows a safety mattress made from resilient foam, and having ventilation holes at the head portion. The mattress does not provide a recess to accommodate a person's face when the person is rested in prone position, nor any elevating structure to reduce postural strains.

French Patent No. 2,431,271 issued to Fontanesia on Jul. 17, 1978, discloses a foam beach mat having a flat surface. This mat would not be comfortable for a person resting in a prone position.

None of the above noted inventions and patents, taken either singly or in combination, is seen to describe the instant invention as claimed.

SUMMARY OF THE INVENTION

Accordingly, it is a principal object of the invention to provide an upper body cushion having a proper support for the spinal column and the neck of a person when lying in a prone position.

It is an object of the present invention to provide an upper body cushion that is composed of inflatable plastic material or rubber, or solid foam material, e.g., foam rubber, for better comfort.

Another object of the present invention is to provide an upper body cushion with a recess and ventilation apertures which communicate with the recess and are positioned on each side of the cushion, to provide a constant flow of fresh air to a user lying in a prone position, with the face in the recess.

It is a further object of the present invention to provide an upper body cushion which effectively eases ailments of the back and neck when a person is lying in a prone position.

An additional object of the present invention is to provide a cushion for increasing relaxation.

Yet another object of the present invention is to provide a cushion having a recess to accommodate a person's face so as to reduce strain from a person's back.

A further object of the present invention is to provide a cushion configured for convenient usage or storage.

An object of the present invention is to provide an upper body support cushion which is economical to produce.

The invention is a body support cushion or pad for face down tanning, or a massage. The body support cushion is made from any suitable material that is firm enough to support a person's body, yet soft enough to be comfortable for a person's face. In a preferred embodiment, the body support cushion is composed of foam rubber so as to enhance the softness of the cushion. The cushion has an elongated recess for accommodating a person's face. Ventilation apertures extend from each side of the pad and are in fluid communication with the elongated facial recess to provide air circulation. The cushion provides a proper postural position when a person is lying in a prone position.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a support cushion of unitary construction for face-down tanning or massage. The cushion is fabricated from either plastic or rubber material which can be inflated, or from a solid foam material, e.g., foam rubber, and has an elongated recess for accommodating a person's face. There are ventilation apertures extending from each side of the cushion and communicating with the recess to provide a continuous air passage for the user.

Figure 1:
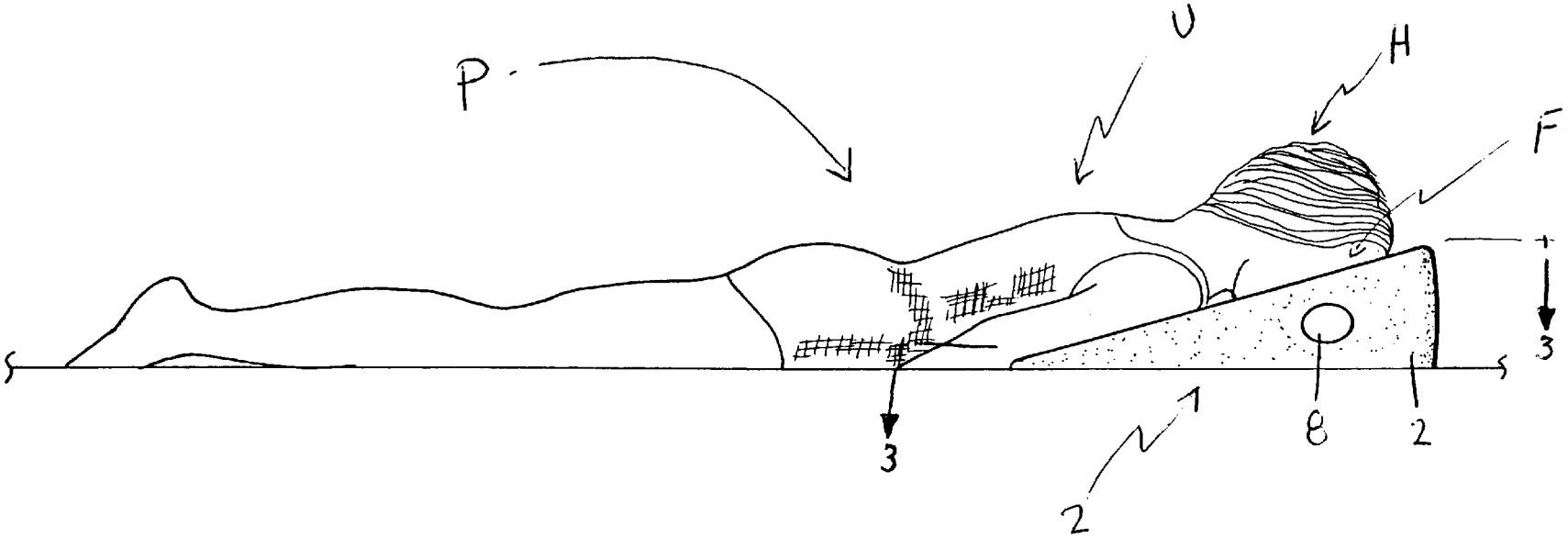
FIG. 1 is an environmental, side elevational view of a first embodiment of the present invention in use.

The preferred embodiments of the various aspects of the present invention will now be explained with reference to the accompanying drawings. By way of illustration and not limitation, FIGS. 1 to 5 are presented to show the preferred embodiments of the invention. FIG. 1, illustrating a first preferred embodiment of the invention, shows a user P lying on a cushion 2 with the upper body U in a prone position or face F down position for sunbathing or massaging. The invention includes ventilation holes 8 extended from each side of the cushion 2, one of which is clearly seen in FIG. 1.

Figure 2:
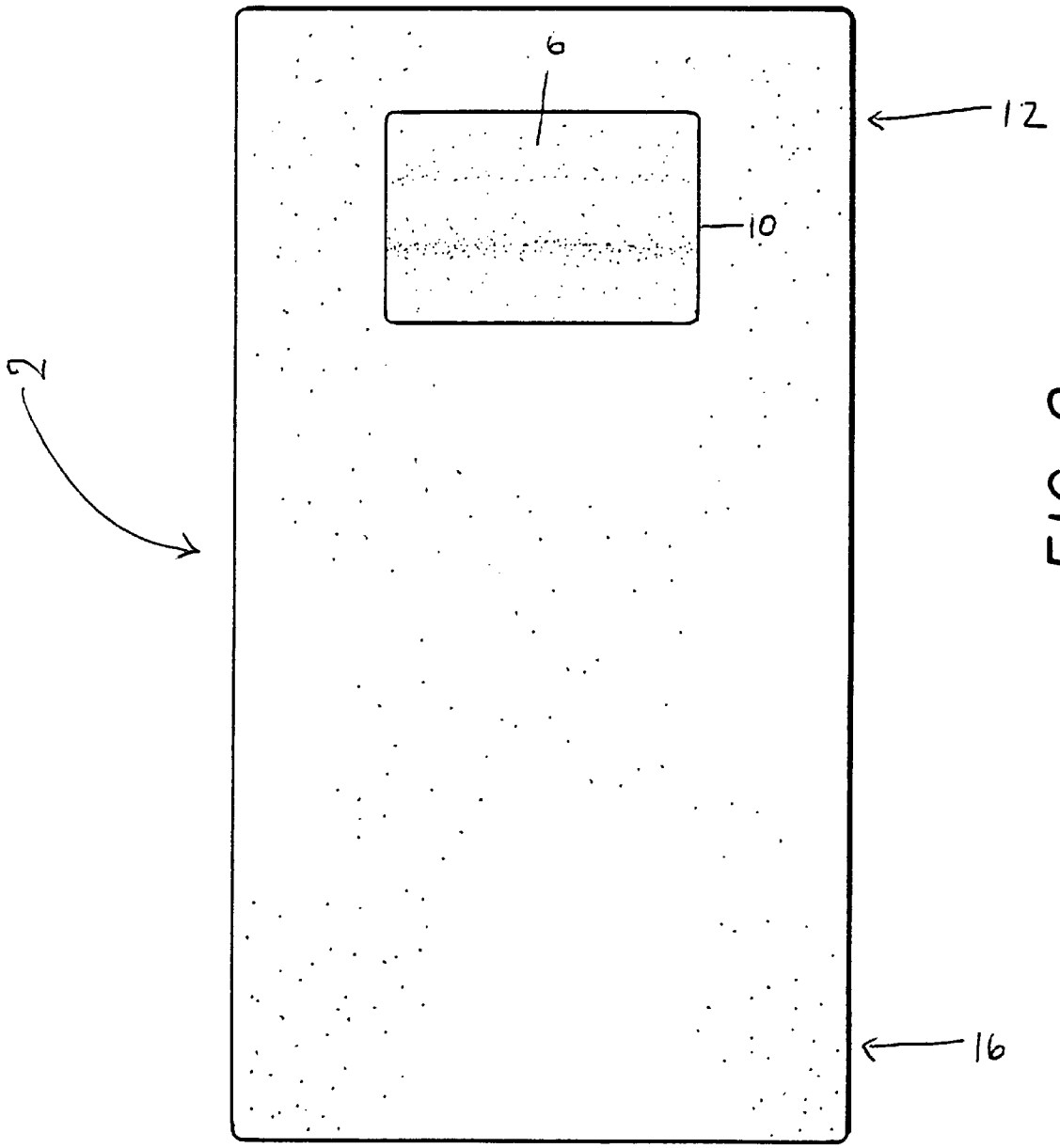
FIG. 2 is a top plan view of the invention as shown in FIG. 1, and drawn to an enlarged scale.
Figure 3:
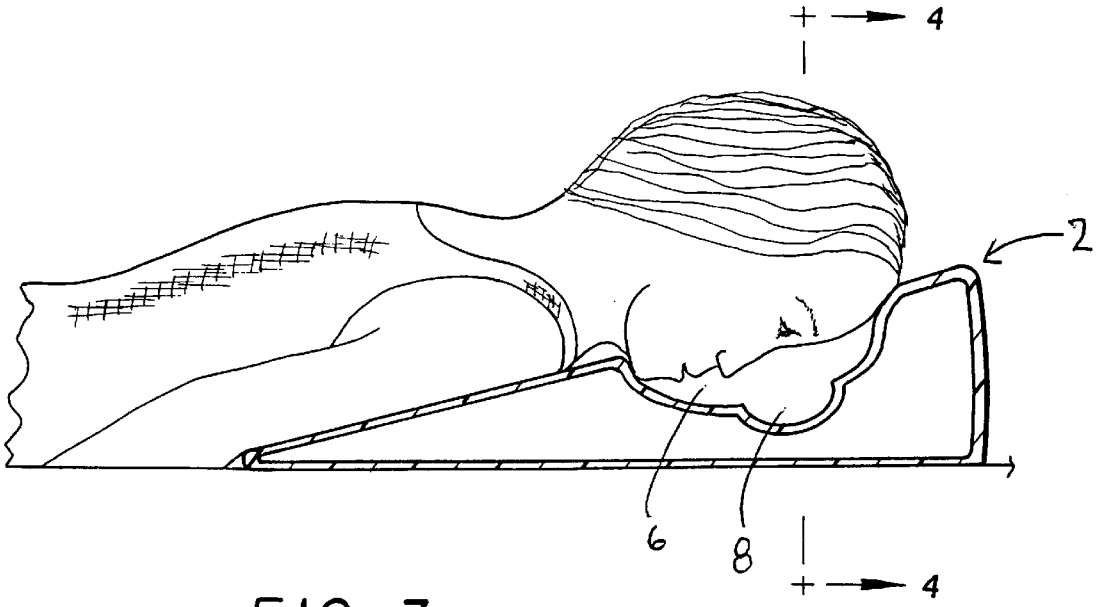
FIG. 3 is an elevational, cross-sectional view taken along lines 3—3 of FIG. 1.
Figure 4:
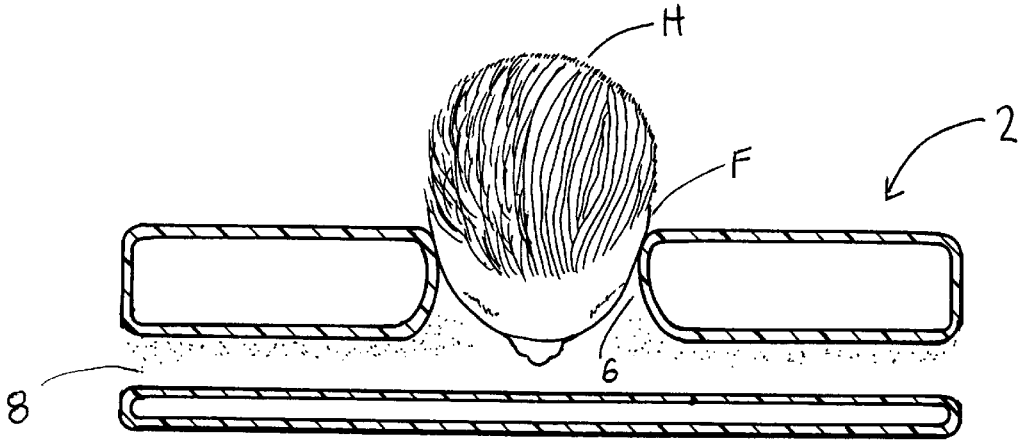
FIG. 4 is an elevational, cross-sectional view taken along lines 4—4 of FIG. 3.

FIG. 2 is a top plan view of the invention showing a cavity 6, dimensioned and configured to accommodate the face F. FIG. 3 further illustrates the configuration of the invention, which conforms with the contour of the user's upper body U and head portions H. FIG. 4 clearly illustrates the intercommunication of the cavity 6 with the side ventilation apertures or holes 8.

Referring again to FIG. 1, the cushion or pad 2 extends from about a user's ribs and terminates just beyond the user's forehead, so as to provide the user an upper body support. The cushion 2 helps to maintain a proper postural position when the user P is lying in a prone position or a face down position, because it has dimensions configured to conform with the upper body U and the head portions H of the user P.

The cushion 2 has a substantial upwardly inclined top surface 18 beginning at a rearward portion 16, then slowly rising to a forward portion 12. The inclined top surface 18 provides a steady elevation and comfortable support for the user's upper body when the user P is lying in a prone position on the cushion 2. Specifically, the forward portion 12 of top surface 18 helps to support the head portion H of the user P, while the rearward portion 16 supports the upper body portion U. Thus, a proper care for the back of the user P is achieved when the user P lies on the stomach.

The cushion 2 is also very useful for people who suffer from spinal disorders, because the configuration of the cushion eases ailments of the back and the neck. In addition, many people accidentally twist their necks when they place their heads on a side while lying on their stomachs for sunbathing or massaging, in order to obtain normal breathing. A major advantage of this invention is to reduce the possibility of neck injury by including a cavity or recess 6 disposed at the forward portion 12 of the cushion 2 to accommodate the user's face F, for correct posture and normal breathing. The recess 6 is disposed in the forward portion 12 of the cushion 2 and is further defined by opposed spaced-apart sections 10, as shown in FIG. 2.

As can be readily seen in FIGS. 3 and 4, the recess 6 is dimensioned and configured to receive and engage the user's face F. A pair of substantially triangular-shaped side walls 20 extend along apposite sides of cushion 2. Ventilation apertures 8 extend from each side wall 20 of the cushion 2 and interconnect with the recess 6 as shown in FIG. 4. Communication between the aperture 8 and the recess 6 provides the user a continuous supply of fresh air, so that normal breathing may be maintained. An end wall 22 and a bottom wall 24 complete the hollow cushion 2.

The cushion 2 is made of plastic or rubber material, which can be inflated and hold pressure. The material is chosen for comfort. The cushion is sized so that it is convenient to carry it from place to place. In addition, when the cushion 2 is deflated, the user P is able easily to store the cushion 2, because the deflated cushion 2 requires only minimum storage space. The inflator mechanism (not shown) can be selected from various types of inflator mechanism well known to one in the art, such as an orally inflatable mechanism.

Figure 5:
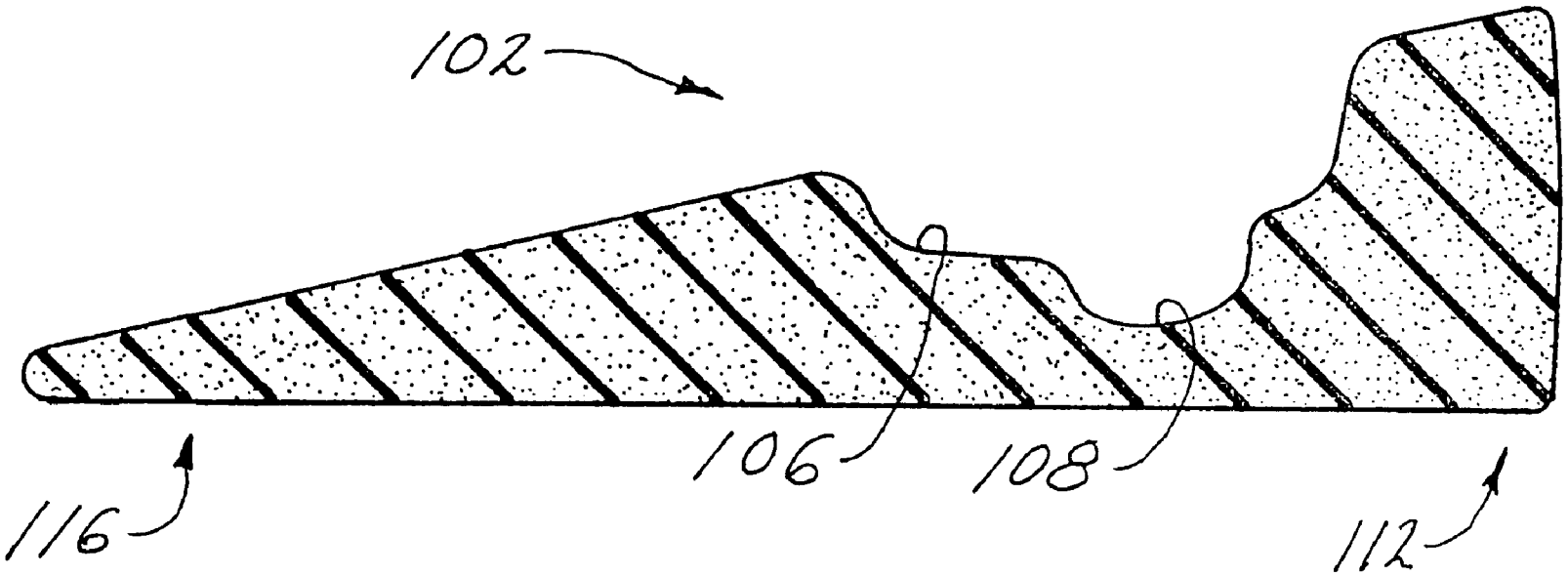
FIG. 5 is an elevational, cross-sectional side view of a second embodiment of the present invention.

A second embodiment of the invention is illustrated in FIG. 5. This embodiment is identical in all respects to the first embodiment, except that it is made of a solid foam material, for example, foam rubber. The cushion 102, likewise, has an upwardly sloped top surface 118, a pair of substantially triangular-shaped side walls 120 an end wall 122, and a bottom wall 124. The cushion 102 has a face accommodating cavity 106 as well as the side ventilation apertures or holes, one of which is illustrated at 108. The foam material of this embodiment provides a suitable softness and comfort. Also, there is no need of worry that the cushion will lose air and deflate, as can be the case with the first embodiment. On the other hand, after use, this embodiment cannot be reduced to a compact storage size as can the first embodiment when fully deflated. However, given the relatively small dimensions of the cushion 102, storage of the device is not a significant problem In operation, the user P lies in a prone position on a towel or any comfortable platform for sunbathing or massaging. He or she then properly positions himself or herself by placing the cushion 2 or 102 under the upper body portion U. The lowest height portion, the rearward portion 16 or 116, of the cushion 2 or 102 is placed against the ribs of the user's body, while the head portion H is rested on top of the forward portion 12 or 112. Face F is placed in the cavity or recess 6 or 106 for correct postural positioning. The user P can maintain normal breathing by inhaling through the nose and exhaling through the mouth while face down in the recess 6 or 106. The ventilation apertures 8 or 108 on the sides of the cushion 2 or 102, and the recess 6 or 106, provide a constant source for fresh air circulation for breathing.

The body support cushion of the present invention provides maximal support and comfort for a person lying in the prone position for a prolonged period of time. The innovative ventilation system with its bilateral ventilation apertures in fluid communication with the elongated facial recess provide the user with the necessary circulation of fresh air to allow the user to completely relax while in the prone position. The contoured configuration of the body support cushion of the present invention provides the appropriate parts of the torso and head with the correct amount of support and comfort.

It should be understood by those skilled in the art that various modifications and adaptations of the present invention as well as alternative embodiments of the present invention may be contemplated. The preferred embodiments of the present invention It is to be understood that the present invention is not limited to the embodiments described above, but encompasses any and all embodiments within the scope of the following claims.

I claim:

1. A device for supporting a user lying in a prone position comprising:

a unitary cushion sized and configured to support a user's body from mid-chest to beyond the forehead;

said unitary cushion having an upwardly inclined top surface including a forward portion defining lower chest-supporting region and a rearward portion defining a head-supporting region, two opposed substantially triangular side walls, a bottom wall and an end wall;

a contoured recess disposed within said head-supporting region; and a ventilation aperture extending through each of said two opposed side walls and communicating with said contoured recess;

wherein said bottom wall forms a coextensive base along said contoured recess and said ventilation aperture;

whereby said coextensive base provides a layer of insulation between said contoured recess and said ventilation aperture and a supporting surface.

2. The cushion as recited in claim 1, wherein:

said cushion has a hollow interior.

3. The cushion as recited in claim 2, wherein:

said cushion is inflatable.

4. The cushion as recited in claim 1, wherein:

said cushion is fabricated from a solid foam material.

5. The cushion as recited in claim 1, wherein:

said contoured recess is configured to conform to a face.

* * * * *